US010102823B2

(12) United States Patent
Coppin et al.

(10) Patent No.: US 10,102,823 B2
(45) Date of Patent: Oct. 16, 2018

(54) TECHNIQUES FOR STORING AND DISPLAYING AN IMAGE ON A DISPLAY DEVICE

(71) Applicant: Microsoft Technology Licensing, LLC, Redmond, WA (US)

(72) Inventors: Justin A. Coppin, Fort Collins, CO (US); Paul W. Martin, Loveland, CO (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 19 days.

(21) Appl. No.: 15/341,823

(22) Filed: Nov. 2, 2016

(65) Prior Publication Data

US 2018/0122334 A1 May 3, 2018

(51) Int. Cl.

| | |
|---|---|
| ***G06T 1/60*** | (2006.01) |
| ***G09G 5/393*** | (2006.01) |
| ***G09G 5/395*** | (2006.01) |
| ***G09G 5/10*** | (2006.01) |

(52) U.S. Cl.

CPC ..... *G09G 5/10* (2013.01); *G09G 2320/0646* (2013.01); *G09G 2330/02* (2013.01)

(58) Field of Classification Search

CPC ..... G09G 2320/0646; G09G 2330/02; G09G 5/39; G09G 5/393; G09G 5/395

USPC ..... 345/530, 545

See application file for complete search history.

(56) References Cited

U.S. PATENT DOCUMENTS

| | | | |
|---|---|---|---|
| 6,756,700 B2 | 6/2004 | Zeng | |
| 7,705,842 B2 | 4/2010 | Panabaker et al. | |
| 7,900,074 B2 | 3/2011 | Reece et al. | |
| 8,028,177 B2 | 9/2011 | Chuang et al. | |
| 8,434,153 B2 * | 4/2013 | Sundaramurthy | G06F 3/0481 713/100 |
| 9,229,516 B2 | 1/2016 | Hiltunen et al. | |
| 2012/0062950 A1 * | 3/2012 | Lee | G03G 15/0863 358/1.15 |

(Continued)

FOREIGN PATENT DOCUMENTS

| | | |
|---|---|---|
| CN | 103616887 B | 2/2016 |
| CN | 103593040 B | 6/2016 |

OTHER PUBLICATIONS

Florian, "Images when starting up from sleep mode", http://www.tenforums.com/general-support/42342-images-when-starting-up-sleep-mode.html, Feb. 2016, 3 pages.

(Continued)

*Primary Examiner* — Jacinta M Crawford

(74) *Attorney, Agent, or Firm* — Arent Fox LLP

(57) ABSTRACT

Examples described herein generally relate to a display device and computing device where a display is configured for displaying images, a display controller is configured for receiving image data via a display port when coupled to a computing device, and sending signals to the display, based on the image data, to cause the display to display the images, and a memory is accessible by the display controller for storing a resume image received from the computing device. The display controller is further configured for detecting a power on event, accessing the memory to obtain the resume image, and sending signals to the display to cause display of the resume image based at least in part on detecting the power on event.

18 Claims, 7 Drawing Sheets

(56) References Cited

U.S. PATENT DOCUMENTS

| | | | | |
|---|---|---|---|---|
| 2012/0207208 | A1* | 8/2012 | Wyatt | G06F 3/14 375/240.01 |
| 2013/0021352 | A1* | 1/2013 | Wyatt | G09G 5/395 345/520 |
| 2013/0069962 | A1 | 3/2013 | Nealer et al. | |
| 2014/0094224 | A1* | 4/2014 | Lozovoy | H04M 1/22 455/566 |
| 2015/0185811 | A1 | 7/2015 | Connell et al. | |
| 2015/0301836 | A1* | 10/2015 | Chung | G06F 9/4406 713/2 |
| 2015/0334219 | A1 | 11/2015 | Soundararajan | |

OTHER PUBLICATIONS

"Technet", http://technetyes.blogspot.in/2011/09/engadget-news_14.html, Sep. 14, 2011, 43 pages.

* cited by examiner

TECHNIQUES FOR STORING AND DISPLAYING AN IMAGE ON A DISPLAY DEVICE

BACKGROUND

Use of computing devices is becoming more ubiquitous by the day. Computing devices range from standard desktop computers to wearable computing technology and beyond. One area of computing devices that has grown in recent years are devices of smaller form factors, such as laptop computers, tablet computers, hybrid computers (e.g., including a removably attachable keyboard), etc. Many types of tablet computers can remain in a mostly powered on state, and simply allow for powering on and off a display to conserve power. Other types of tablet computers, laptop computers, hybrid computers, etc., may use more complex power states, due to having more complex components, to save additional power. Transitioning between these power states (e.g., to a full power on state from a lower power state) may result in the display remaining blacked out for a period of time after user input indicating a desire to transition to another power state is received (e.g., by pressing a power button, pressing a key on a keyboard, moving a mouse, opening a housing portion of the device, etc.), as additional time may be needed to power on the various components of the computer. This may lead to confusion as to whether the input was sufficient (e.g., whether the button or key press, mouse movement, etc. entailed enough movement for detection), or whether the computing device has sufficient battery to power on, etc.

SUMMARY

The following presents a simplified summary of one or more examples in order to provide a basic understanding of such examples. This summary is not an extensive overview of all contemplated examples, and is intended to neither identify key or critical elements of all examples nor delineate the scope of any or all examples. Its sole purpose is to present some concepts of one or more examples in a simplified form as a prelude to the more detailed description that is presented later.

In an example, a display device is provided including a display configured for displaying images, a display controller configured for receiving image data via a display port when coupled to a computing device, and for sending signals to the display, based on the image data, to cause the display to display the images, and a memory accessible by the display controller for storing a resume image received from the computing device. The display controller is further configured for detecting a power on event, accessing the memory to obtain the resume image, and sending signals to the display to cause display of the resume image based at least in part on detecting the power on event.

In another example, a computing device is provided including a memory, a display interface configured for communicating image data to a display device for displaying on a display, and at least one processor coupled to the memory and the display interface via a bus. The at least one processor is configured for initiating a power down sequence at the computing device related to decreasing or terminating power provided to one or more components of the computing device including the display interface, generating a resume image to be displayed on the display in a subsequent power on event and before the display interface communicates image data to the display device following the power on event, and sending, as part of the power down sequence and before decreasing or terminating power to the display interface, the resume image to the display device via the display interface.

In another example, a method for displaying a resume image based on a power on event at a display device. The method includes initiating a power down sequence at a computing device, communicating the resume image from the computing device to an display device based in part on the power down sequence, storing the resume image in a memory accessible by a display controller of the display device, detecting a power on event at the computing device, displaying, on the display device, the resume image from the memory accessible by the display controller based in part on detecting the power on event, and displaying, on the display device, subsequent images based on image data received from the computing device following the power on event.

To the accomplishment of the foregoing and related ends, the one or more examples comprise the features hereinafter fully described and particularly pointed out in the claims. The following description and the annexed drawings set forth in detail certain illustrative features of the one or more examples. These features are indicative, however, of but a few of the various ways in which the principles of various examples may be employed, and this description is intended to include all such examples and their equivalents.

DETAILED DESCRIPTION

Figure 1:
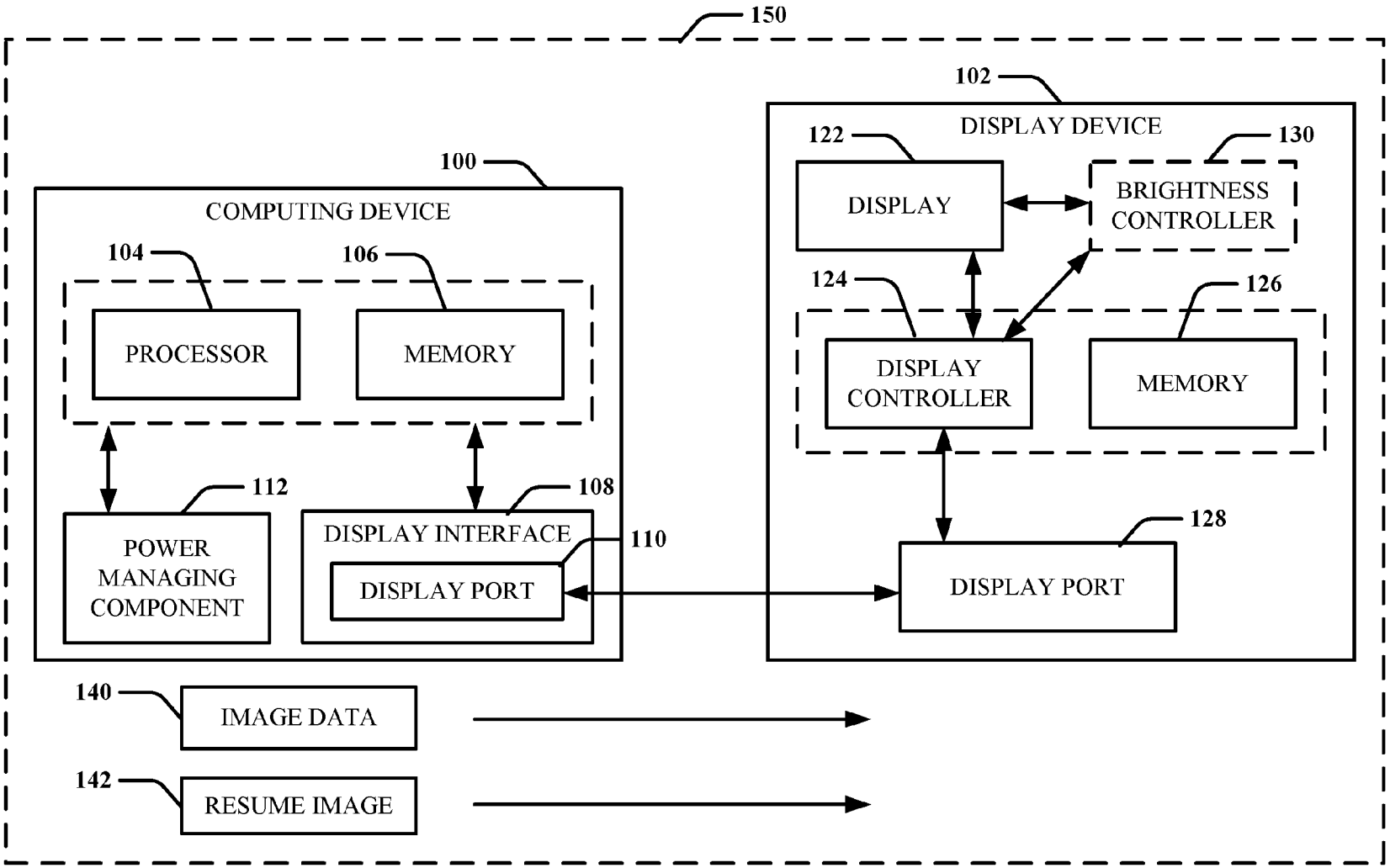
FIG. 1 is a schematic diagram of an example of a computing device and display device communicatively coupled for sending image data in accordance with examples described herein.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are shown in block diagram form in order to avoid obscuring such concepts.

Described herein are various examples related to storing a resume image in a memory of a display device for displaying when the display device is powered on and before other image data is received for displaying. Then, in an example, when the display device receives image data from a computing device, the display device can display images corresponding to the image data instead of the resume image. The resume image can be a high resolution image, such as an image configured for display at a background for an operating system of the computing device, a background for a lock screen of the operating system that typically facilitates entry of credentials to access the computing device, or another image. Thus, for example, the computing device may send the resume image to the display device for storing in the memory of the display device (e.g., as part of a previous power down sequence). Display of this resume image from the memory on the display device can occur more quickly than image data is received from the computing device, in some examples, and thus can provide an early indicator that a power on event (e.g., pressing of a power button on the computing device) was successful. In addition, for example, a dimmed version of the resume image can be displayed until the image data is received from the computing device, which can indicate the computing device is powered on but not yet in a full power or otherwise active state.

In a specific example, the display device can include a display controller, such as a timing controller (TCON), a controller on a display driver integrated circuit (DDIC), or other hardware or software-implemented controller, for receiving image data from a display port that interfaces with a computing device, and sending signals to a display to display images corresponding to the image data. The display controller can include a memory, which can store the resume image. In this example, when the display device is powered on, the display controller can obtain the resume image from the memory (if the memory includes a resume image), and can send signals to the display to display the resume image. When the display controller detects image data received via the display port, the display controller can then send signals to the display that correspond to the image data instead of the resume image. Accordingly, the display controller provides for displaying the resume image in a period of time shortly after a power on event for the display device and receiving image data from the computing device. Additionally, in a specific example, the computing device can generate the resume image as part of a power down sequence, and can send the resume image to the display device, for subsequently displaying when a power on event occurs, before sending a signal to decrease or terminate power to the display device.

Figure 2:
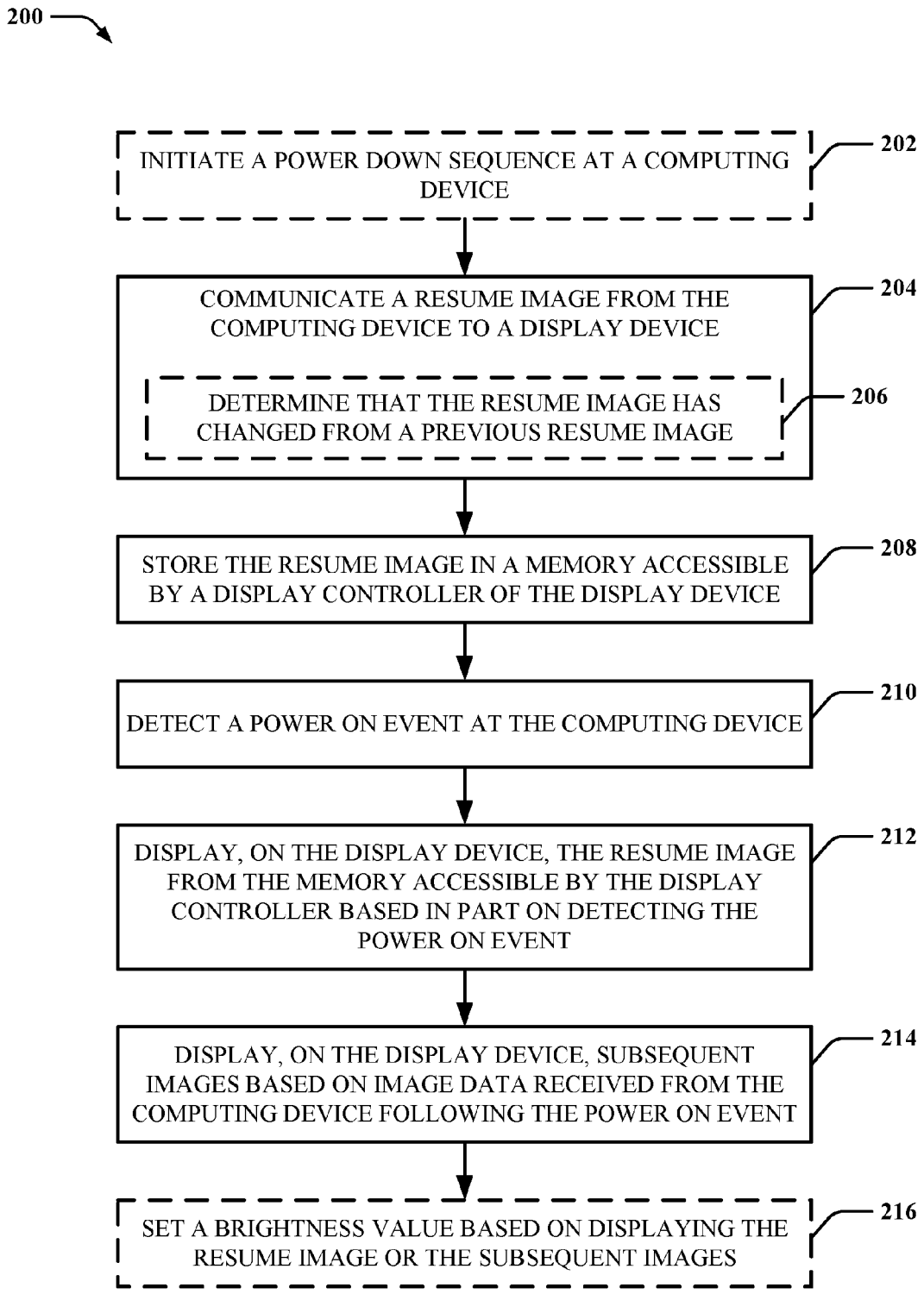
FIG. 2 is a flow diagram of an example of a method for displaying resume images and subsequent images in accordance with examples described herein.
Figure 3:
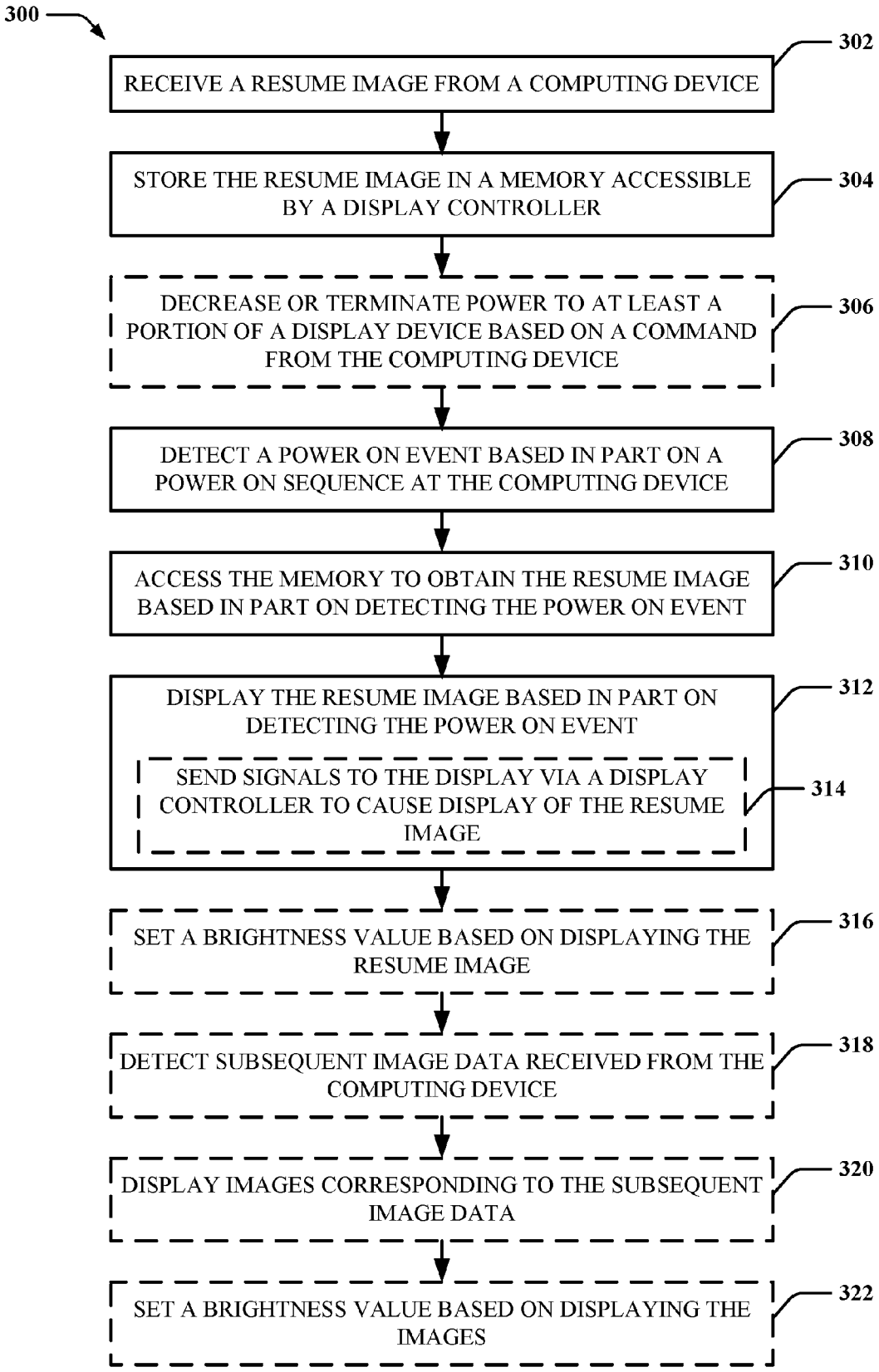
FIG. 3 is a flow diagram of an example of a method for displaying resume images stored in a memory in accordance with examples described herein.
Figure 4:
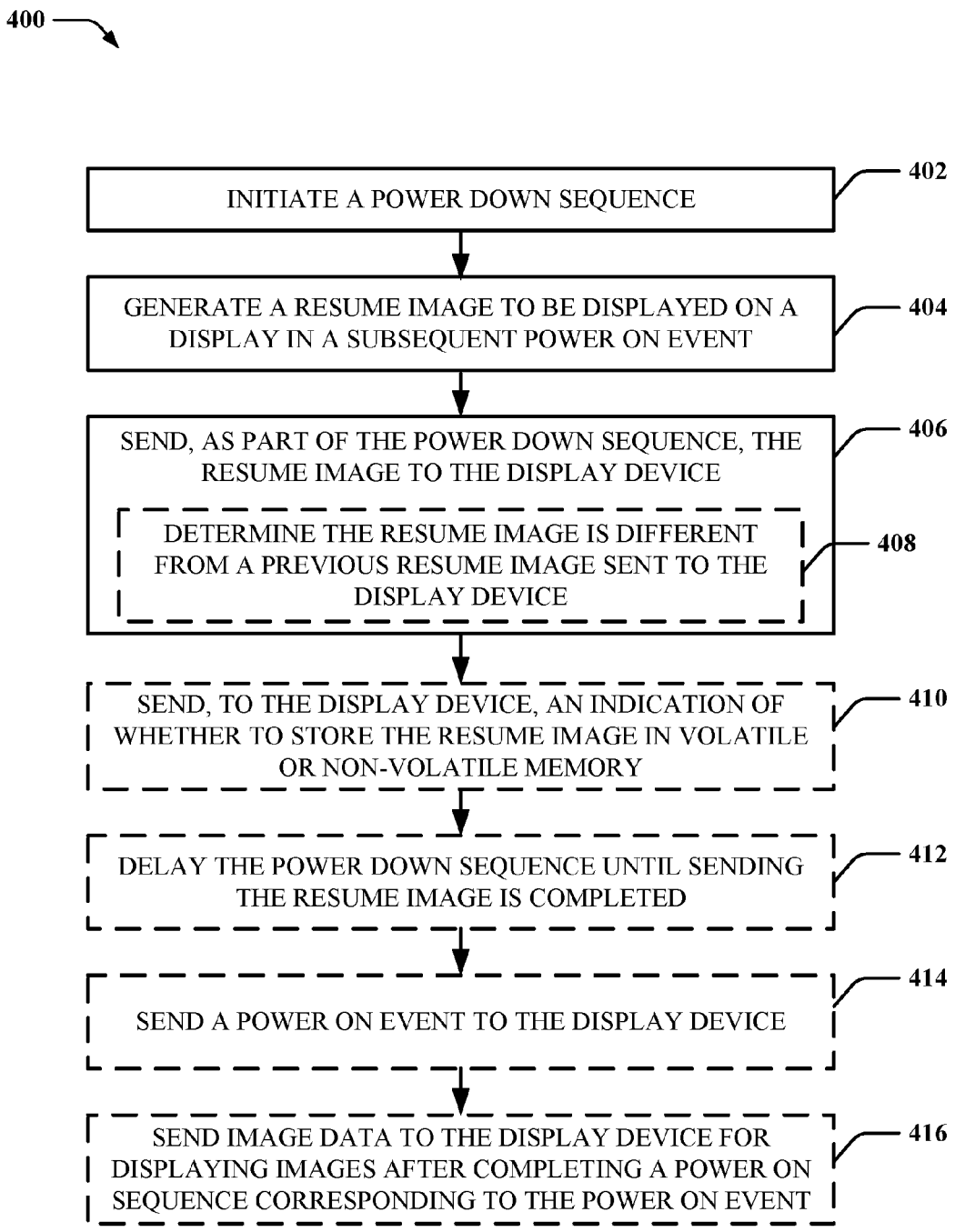
FIG. 4 is a flow diagram of an example of a method for providing resume images to a display device in accordance with examples described herein.

Turning now to FIGS. 1-4, examples are depicted with reference to one or more components and one or more methods that may perform the actions or operations described herein, where components and/or actions/operations in dashed line may be optional. Although the operations described below in FIGS. 2-4 are presented in a particular order and/or as being performed by an example component, the ordering of the actions and the components performing the actions may be varied, in some examples, depending on the implementation. Moreover, in some examples, one or more of the following actions, functions, and/or described components may be performed by a specially-programmed processor, a processor executing specially-programmed software or computer-readable media, or by any other combination of a hardware component and/or a software component capable of performing the described actions or functions.

FIG. 1 is a schematic diagram of an example of a computing device 100 and display device 102 that can communicate image data for displaying images on the display device 102. For example, the display device 102 may be an internal display that is within the same housing 150 as computing device 100, a display device that is external to computing device 100, and/or the like. For example, computing device 100 may include or may otherwise be coupled with a processor 104 and/or memory 106, where the processor 104 and/or memory 106 may be configured to execute or store instructions or other parameters related to communicating image data to the display device 102, as described herein. Computing device 100 may also include a display interface 108 communicatively coupled with the processor 104 and/or memory 106 for communicating with the display device 102 via a display port (DP) 110. A display port, as referred to herein, may also include various types of ports, including high definition multimedia interface (HDMI) ports, display serial interface (DSI) ports, mobile industry processor interface (MIPI) DSI ports, universal serial bus (USB) ports, Firewire ports, or other embedded or external wired or wireless display ports that can allow communications between computing device 100 and display device 102. Additionally, the computing device 100 may include a power managing component 112 for managing multiple power states at the computing device 100 to allow for operating the computing device 100 with decreased power to conserve power used by the computing device 100.

For example, power managing component 112 may operate the computing device 100 in a full power state, one or more decreased power states, and/or may terminate power at the computing device 100 (e.g., except to a controller to detect pressing of a power button). For example, the one or more decreased power states may include one or more standby states (also referred to as modern standby or connected standby) where components of the computing device 100 operate in a low power idle mode and can transition to a full power on state based on detecting user input and/or operating system maintenance commands. In another example, the one or more decreased power states may include one or more sleep states where power is retained to certain components of the computing device 100, such as a volatile memory, a network interface to allow wake-on-local area network (LAN), etc., to allow the computing device 100 to power on more quickly than from a terminated power state. The terminated power states may include a complete shutdown and termination of power of the computing device 100, a hibernate state where context information can be saved to a non-volatile memory for recalling when the computing device 100 is powered on from a complete shutdown, etc. These are non-limiting examples of power states, and the computing device 100 can use substantially any power state where power to at least one component is decreased for a period of time. Entering such a power state may cause generation of a resume image, as described herein, and/or a type of the power state may cause generation of different resume images, generation of a command indicating one of multiple types of memory at the display device within which to store the resume image, etc., as described further herein.

For example, display device 102 may include a display for displaying one or more images based on signals received from a display controller 124. In an example, display controller 124 can be a timing controller (TCON), a controller integrated into a display driver integrated circuit (DDIC), a function provided in firmware, hardware, or software on another device for the purpose of controlling display timing, etc. For example, the display 122 may include a liquid crystal display (LCD) (which may include a light emitting diode (LED) backlit LCD display), organic LED (OLED) display, digital light processing (DLP) display, etc. and may be a monitor, a television, a projector, or substantially any type of embedded, external, wireless, etc. display configured for communicating with a communicating device via an embedded, external, or wireless display port. For example, display device 102 may also include a display controller 124 for providing signals to the display 122 to cause display of images, and a memory 126 accessible by the display controller 124, which may be a volatile or non-volatile memory. In an example, the display controller 124 may include a printed circuit board (PCB), programmable logic controller (PLC), etc. coupled with the display 122. Thus, for example, display controller 124 may be or may include a processor configured for sending the signals to the display 122 based on image data received via a display port 128. Memory 126 may also be included on a PCB of the display controller 124, within a similar housing or packaging as display controller 124, etc. In addition, for example, a portion of memory 126 may store instructions for executing one or more functions of the display controller 124 described herein. Moreover, display controller 124 may reside in a housing with the display 122 and/or display port 128 to comprise the display device 102. In an example, display device 102 may also include a brightness controller 130 for controlling a brightness setting that may be present on the display device 102.

In an example, computing device 100 can generate image data 140 for providing to the display device 102 for displaying on display 122. Computing device 100 can accordingly communicate the image data 140 to the display device 102 via display interface 108 (e.g., an operating system executing on the computing device 100 can provide image data to the display interface 108 via a hardware driver). The display interface 108 sends the image data over display port 110 to display device 102, which receives the image data via display port 128. Display controller 124 can obtain the image data from the display port 128, and can generate and provide signals to display 122 to facilitate displaying of corresponding images by display 122.

In examples described further herein, computing device 100 may generate a resume image 142 (e.g., corresponding resume image data) for displaying by the display device 102 when powering on following a power down sequence. Computing device 100 may generate, e.g., via processor 104, the resume image 142, which may be an image configured at computing device 100 for displaying at a lock screen when the computing device is locked and awaiting user verification. Computing device 100 may then provide the resume image 142 to the display device 102 via display interface 108. Display controller 124 can receive the resume image 142 via display port 128, and can store the resume image in memory 126. Thus, memory 126 can be capable of storing a high resolution image. Accordingly, when the display device 102 detects a power on event (e.g., based on computing device 100 sending an initial signal to the display device 102 as part of a power on sequence when switching to a powered on state after operating in a decreased or terminated power state), display controller 124 can obtain the resume image 142 from memory 126, and can send signals to the display 122 to display the resume image 142. When subsequent image data 140 is received from the computing device 100 (e.g., after a power on sequence is completed), display controller 124 can send signals to the display 122 based on the image data to cause display of associated images instead of the resume image 142. Thus, display device 102 can display the resume image 142 with minimal delay after being powered on until remaining components of the computing device 100 are powered on and image data 140 can be sent to the display device 102.

Moreover, in one example, computing device 100 and display device 102 can be housed in the same housing 150 and/or a removably couplable housing. In this example, display ports 110, 128 can include one or more embedded display ports that are embedded on a PCB of the computing device 100 and/or display device 102, embedded on the removable couplable housing portions such that coupling the housing portions results in coupling of the display ports 110, 128, etc.

FIG. 2 is a flowchart of an example of a method 200 for providing a resume image to a display device for displaying based on detecting a power on event as part of a power on sequence. For example, method 200 may be performed by a computing device and display device communicatively coupled with one another for displaying the resume image while the computing device transitions between power states.

In method 200, optionally at action 202, a power down sequence can be initiated at a computing device. In an example, power managing component 112, e.g., in conjunction with processor 104 and/or memory 106, can initiate the power down sequence at the computing device 100. As described, the power down sequence can correspond to a transition of the computing device 100 from one power state to another power state where power to at least one or more components of the computing device 100 is decreased and/or terminated. For example, the power states may include at least one of a full power state, a decreased power state (e.g., standby, sleep, etc.), a terminated power state (e.g., which may include hibernate) and/or the like. Accordingly, for example, when transitioning from a full power state to a decreased power state, or from a full or decreased power state to a terminated power state, power managing component 112 may execute a power down sequence to execute one or more actions prior to, and including, decreasing or terminating power from one or more components of the computing device 100 (e.g., one or more interfaces, portions of a processor 104 and/or memory 106, one or more input or output devices, such as a display device 102 where integrated with the computing device 100, etc.).

In method 200, at action 204, a resume image can be communicated from the computing device to a display device. In an example, power managing component 112, e.g., in conjunction with processor 104, memory 106, display interface 108, and/or display port 110, can communicate the resume image 142 from the computing device 100 to the display device 102. For example, power managing component 112 can obtain the resume image from memory 106, which can include obtaining an image otherwise configured by computing device 100 (e.g., by processor 104 and/or an operating system executing on the processor 104) for displaying as a desktop background and/or at a lock screen, obtaining an image generated by the computing device 100 (e.g., by processor 104 and/or an operating system executing on the processor 104) for a specific power state, obtaining other images generated by computing device 100 (e.g., based on notifying an operating system executing on the processor 104 of the power down sequence), etc. In this regard, the resume image 142 can be a high resolution image for display as a full screen (or near full screen) image and at a full supported color depth of the display device 102 and/or display interface 108 (e.g., 18 bits per pixel, 24 bits per pixel, 30 bits per pixel, etc.). In this regard, for example, the memory 126 can be of a size large enough to accommodate storing the high resolution resume image 142, as opposed to smaller memories that may be used by TCONs to store a small logo or factory set low resolution monochrome image hardcoded into the display.

In an example, in communicating the resume image at action 204, optionally at action 206, it can be determined that the resume image has changed from a previous resume image. In an example, power managing component 112, e.g., in conjunction with processor 104 and/or memory 106, can determine that the resume image 142 has changed from a previous resume image that was provided to the display device 102. In this regard, for example, where the resume image 142 is the same as a previous resume image, power managing component 112 may not need to again communicate the resume image 142 to the display device 102, as the display device 102 can use the previously provided resume image. This can conserve time and/or resources used in sending the resume image, writing the resume image to memory at the display device 102, etc.

In method 200, at action 208, the resume image can be stored in a memory accessible by a display controller of the display device. In an example, display controller 124, e.g., in conjunction with receiving the resume image 142 from display port 128, can store the resume image 142 in the memory 126. For example, memory 126 can be accessible by display controller 124, and thus may be integrated within the display device 102. In one example, the memory 126 can be communicatively coupled with a PCB corresponding to the display controller 124, etc. In addition, for example, communicating the resume image 142 by the power managing component 112 can be based on, or otherwise include, a command to store the resume image 142 in the memory 126. Accordingly, display controller 124 can be configured to process such commands received from a computing device 100 over display port 128, and can accordingly store the resume image 142 in memory 126. For example, to the extent memory 126 includes a resume image, display controller 124 may overwrite the resume image stored in memory 126 with resume image 142.

In another example, display controller 124 may be configured to store multiple resume images for multiple purposes, and may include logic for displaying an appropriate resume image. For example, display controller 124 may be configured to store a resume image for each of multiple power states for displaying based on a power state corresponding to the power down sequence or to a power on event or related power on sequence. In an example, in this regard, the command from the power managing component 112 may also include one or more power states (e.g., a power down state or power on state) associated with the resume image 142. In another example, display controller 124 may be configured to store multiple resume images as part of a sequential display of images based on a period of time (e.g., resume images that change or cycle every second, an animation of resume images, etc.). In this example, the command from the power managing component 112 may include the various resume images, a time period for displaying each image, an order for displaying the images, etc.

In method 200, at action 210, a power on event can be detected at the computing device. In an example, power managing component 112, e.g., in conjunction with processor 104 and/or memory 106, can detect the power on event at the computing device 100. For example, the power on event may be caused by pressing a power button on the computing device 100, pressing a button on an input device of the computing device 100 (e.g., a keyboard, touch screen, or mouse), a wake-on-LAN event, etc. In an example, power managing component 112 can begin a power on sequence at the computing device 100, which may also include communicating an initial signal to the display device 102 via display interface 108 or another connection between the computing device 100 and display device 102 (e.g., a power source where computing device 100 and display device 102 are integrated in the same housing 150 or as coupled portions of a housing 150). Thus, in an example, display controller 124 can detect the power on event at the computing device 100 in the form of receiving the initial signal from the computing device 100 over the display port 128 or another power connection (not shown). In either example, the display device 102 may also be operating in a decreased power state based on a previous signal received from computing device 100 to decrease power at the display device 102, and the initial signal sent as part of the power on event may correspond to restoring power at the display device 102.

In method 200, at action 212, the resume image from the memory accessible by the display controller can be displayed, on the display device, based in part on detecting the power on event. In an example, display controller 124, e.g., in conjunction with display 122 and/or memory 126, can display, on the display device 102 (e.g., via display 122) the resume image 142 from the memory 126 accessible by the display controller 124. For example, display controller 124 can retrieve the resume image 142 based on detecting the power on event. Display controller 124 can communicate signals to the display 122 to cause display of the resume image 142.

In method 200, at action 214, subsequent images can be displayed, on the display, based on image data received from the computing device following the power on event. In an example, display controller 124, e.g., in conjunction with display 122 and/or memory 126, can display, on the display device 102 (e.g., via display 122) the subsequent images based on the image data 140 received from the computing device 100 following the power on event. For example, computing device 100 may provide the image data 140 to the display device 102 via display interface 108 once a corresponding power on sequence is completed. Display controller 124 can detect the image data 140 via display port 128, and can accordingly send signals to the display 122 to display images corresponding to the image data 140 instead of the resume image 142. Thus, display device 102 can display the resume image 142 based on detecting the power on event and until actual image data 140 is received from the computing device 100 following the power on sequence. In one example, display controller 124 may delete the resume image 142 from memory 126 based on receiving and/or displaying the image data 140. In one example, the subsequent images may include images from the lock screen as received from computing device 100.

In method 200, optionally at 216, a brightness value can be set based on displaying the resume image or the subsequent images. In an example, brightness controller 130, e.g., in conjunction with display controller 124 and/or memory 126, can set a brightness value of the display 122 based on displaying the resume image or the subsequent images. For example, brightness controller 130 may set the brightness value (e.g., on an OLED display), or a backlight value on a backlit LED display, when displaying the resume image 142, where the brightness value or backlight value used can be a portion of a value configured by the computing device 100, or an otherwise fixed value, so the resume image 142 appears dimmed. Then when the subsequent images are displayed, for example, brightness controller 130 may set the brightness/backlight value to the value configured by the computing device 100, which may include an immediate setting of the brightness/backlight value, a gradual setting of the brightness/backlight value to provide a ramping up effect, etc. In one example, in setting the brightness value, brightness controller 130 may control image brightness by dynamically adjusting pixel values in a pipeline for display to achieve a desired level of brightness.

FIG. 3 is a flowchart of an example of a method 300 for storing and displaying a resume image at a display device. For example, method 300 may be performed by a display device that is communicatively coupled with a computing device for displaying the resume image while the computing device transitions between power states.

In method 300, at action 302, a resume image can be received from a computing device. In an example, display controller 124, e.g., in conjunction with memory 126 and/or display port 128, can receive the resume image 142 from the computing device 100. For example, display controller 124 can receive the image as part of a power down sequence at the computing device 100 to transition from one power state to another power state having decreased or terminated power to one or more components. In one example, display controller 124 can receive the resume image 142 as part of a command to store the resume image 142, where the command may also include an indication of a type of the power down sequence, an indication of a type of power on event or sequence for which to display the resume image 142, an indication of a type of memory within which to store the resume image 142, etc., as described. Moreover, in an example, the command may include a plurality of resume images, a period of time for displaying each of the plurality of resume images, etc. Additionally, in an example, the command from the computing device 100 may relate to a command to the display device 102 to decrease or terminate power to one or more components of the display device 102 as part of the power down sequence, and display controller 124 can store the resume image 142, as described further herein, before decreasing or terminating power to the one or more components based on the command.

In method 300, at action 304, the resume image can be stored in a memory accessible by the display controller. In an example, display controller 124, e.g., in conjunction with memory 126, can store the resume image 142 in the memory 126 accessible by the display controller 124. For example, the memory 126 can be on a PCB associated with the display controller 124 or otherwise communicatively coupled with the display controller 124 and residing at the display device 102 for local storage of the resume image 142. In an example, the memory 126 may include one or more of a volatile memory (e.g., dynamic random access memory (DRAM), static random access memory (SRAM), etc.), a non-volatile memory (e.g., flash memory), etc. In one example, display device 102 can include multiple types of memory (e.g., DRAM/SRAM and flash memory). In one example, a command from the computing device 100 including the resume image 142 can also include an indication of which memory to use in storing the resume image 142. In another example, display device 102 can choose the type of memory, which may be based on other information in the command (e.g., a type of power down sequence associated with the resume image 142, a type of power on event or sequence associated with the resume image 142, etc.). Further, in an example, display controller 124 may delete or overwrite one or more resume images stored in the memory 126 in storing resume image 142 in the memory 126. Further, in an example, display controller 124 can include a hardware decoder for decompressing a resume image, and may accordingly store the resume image 142 as a compressed image (which may be compressed when received from computing device 100).

Moreover, for example, display controller 124 can store the resume image 142 in a panel self refresh (PSR) buffer defined in memory 126. For example, the display controller 124 can otherwise utilize the PSR buffer in normal full power operations to store a static image received from the computing device 100 for display until the images from computing device 100 to be displayed are changed. Accordingly, when receiving the resume image 142 from the computing device 100 as part of a power down sequence, display controller 124 can store the resume image 142 in the PSR buffer prior to decreasing or terminating power to one or more components of the display device 102. When the computing device 100 is transitioned to a sleep state, power can be retained to the PSR buffer to facilitate storing the resume image 142, though power can be terminated from other portions of the display device 102. In an example, where display controller 124 stores the resume image 142 in a volatile memory, such as the PSR, where power is terminated to memory 126 (e.g., when the display device 102 is powered off completely), however, the resume image 142 may be lost, and display controller 124 can display a logo or factory set low resolution image on the display device 102 when powered back on. In one example, display controller 124 can communicate a signal to the computing device, e.g., via display port 128, when writing the resume image 142 to memory 126 is completed.

In method 300, optionally at action 306, power to at least a portion of a display device can be decreased or terminated based on a command from the computing device. In an example, display controller 124, e.g., in conjunction with memory 126, can decrease or terminate power to at least a portion of the display device 102 based on the command from the computing device 100. As described, for example, the command from the computing device 100 can be mechanism by which the resume image is received 142. In any case, the command may indicate to decrease or terminate power to a backlight of the display (e.g., for a LED LCD), decrease or terminate power to a display controller 124, decrease or terminate power to memory 126 (e.g. decrease where memory 126 is a DRAM/SRAM to retain contents of the memory 126), etc.

In method 300, at action 308, a power on event based in part on a power on sequence at the computing device can be detected. In an example, display controller 124, e.g., in conjunction with memory 126, can detect the power on event based in part on a power on sequence at the computing device 100. For example, the computing device 100 may transmit an initial signal as part of the power on sequence, which can be received by the display controller 124 and detected as the power on event. In one example, the initial signal may include information related to powering on one or more components of the display device 102 that may have been operating at a decreased or terminated power. In another example, the initial signal may be a power signal that provides power to one or more components of the display device 102 that may have been operating at a decreased or terminated power.

In method 300, at action 310, the memory can be accessed to obtain the resume image based in part on detecting the power on event. In an example, display controller 124, e.g., in conjunction with memory 126, can access the memory 126 to obtain the resume image 142 based in part on detecting the power on event. For example, display controller 124 can access one of a plurality of types of memory to obtain the resume image 142, which may be based on a type of the power on event or related power on sequence. As described, the command associated with the resume image 142 may indicate a type of power down sequence, display controller 124 can obtain the resume image 142 in a type of memory associated with the power down sequence when correspondingly detecting the power on event. For example, a command related to a sleep state may indicate to store the resume image 142 in a volatile portion of memory 126 while a hibernate state may indicate to store the resume image 142 in a non-volatile memory portion of memory 126. Accordingly, where the power on event is detected, accessing the memory 126 can include accessing the volatile portion of memory 126 where the previous power down sequence corresponded to a sleep state, or accessing the non-volatile portion of memory 126 where the previous power down sequence corresponded to a hibernate state. Additionally, in an example, accessing the memory 126 may include display controller 124 obtaining multiple resume images, related periods of time for displaying each of the multiple resume images, etc.

In method 300, at action 312, the resume image can be displayed based in part on detecting the power on event. In an example, display controller 124, e.g., in conjunction with display 122 and/or memory 126, can display the resume image 142 based in part on detecting the power on event. For example, in displaying the resume image at action 312, optionally at action 314, signals can be sent to the display via a display controller to cause display of the resume image. In an example, display controller 124, e.g., in conjunction with memory 126, can send signals to the display 122 to cause display of the resume image 142 retrieved from memory 126, which may be based in part on detecting the power on event (e.g., receiving the initial signal). In an example, where the initial signal includes a command to power on a portion of the display device 102, display controller 124 can accordingly power on the portion of the display device 102 and then can display the resume image 142. Where no resume image can be obtained from memory 126 (e.g., where power is lost to memory 126), display controller 124 can display a logo or factory set low resolution image on the display device 102 when powered back on.

In method 300, optionally at action 316, a brightness value can be set based on displaying the resume image. In an example, brightness controller 130, e.g., in conjunction with display controller 124 and/or memory 126, can set the brightness value (e.g., of display 122) based on displaying the resume image. For example, brightness controller 130 can set the brightness value of an OLED or other display, or a backlight value for a backlit LCD display for example, to a portion of a configured value or an otherwise fixed value so the resume image 142 appears dimmed, which can be interpreted as the computing device 100 being in a powered on state but not yet ready to receive and process input.

In method 300, optionally at action 318, subsequent image data received from the computing device can be detected, and optionally at action 320, images corresponding to the subsequent image data can be displayed. In an example, display controller 124, e.g., in conjunction with memory 126 and/or display port 128, can detect subsequent image data received from the computing device, and can display images corresponding to the subsequent image data. For example, after the power on sequence is completed at the computing device 100, the computing device 100 can send image data for displaying images on display device 102. Once the image data is detected, display controller 124 can send signals to the display 122 to display corresponding images instead of the resume image 142. Thus, display controller 124 facilitates display of the resume image 142 from a period of time shortly after a power on sequence begins at the computing device 100 until receiving image data from the computing device 100 for displaying on display device 102.

In method 300, optionally at 322, a brightness value can be set based on displaying the images. In an example, brightness controller 130, e.g., in conjunction with display controller 124 and/or memory 126, can set the brightness value based on displaying the images. For example, brightness controller 130 can set the brightness value of an OLED display, or a backlight value of a backlit LCD display, to a configured value (e.g., a value configured via a user interface, which can be interpreted as the computing device 100 being ready to receive and process input. For example, in setting the brightness value based on displaying the images, brightness controller 130 may gradually increase the brightness value over a period of time to provide a ramping up effect.

FIG. 4 is a flowchart of an example of a method 400 for providing a resume image to a display device. For example, method 400 may be performed by a computing device that is communicatively coupled with a display device.

In method 400, at action 402, a power down sequence can be initiated. In an example, power managing component 112, e.g., in conjunction with processor 104 and/or memory 106, can initiate the power down sequence. For example, the power down sequence can relate to transitioning the computing device 100 from one power state to another power state having a decreased power consumption (e.g., from a full power on state to a standby, sleep, hibernate, or terminated power state, from a standby state to a sleep, hibernate, or terminated power state, etc.). In an example, the power down sequence can include performing one or more actions before, and in addition to, decreasing or terminating power to one or more components of the computing device 100.

In method 400, at action, 404, a resume image can be generated to be displayed on a display in a subsequent power on event. In an example, power managing component 112, e.g., in conjunction with processor 104 and/or memory 106, can generate the resume image 142 to be displayed on the display in the subsequent power on event. For example, power managing component 112 can generate the resume image 142 as a high resolution image, and may include an image configured by an operating system executing on processor 104 to be displayed as a desktop background and/or at a lock screen. In another example, power managing component 112 can generate the resume image 142 prior to initiating the power down sequence and/or may thus use the same resume image for display in multiple power on events. Moreover, for example, power managing component 112 may generate a plurality of resume images and/or a period of time for displaying each of the plurality of resume images (e.g., in a slideshow, animation, video, etc.).

In method 400, at action 406, the resume image can be sent to the display device as part of the power down sequence. In an example, power managing component 112, e.g., in conjunction with processor 104, memory 106, display interface 108, and/or display port 110, can send, as a part of the power down sequence, the resume image 142 to the display device 102. For example, power managing component 112 can send the resume image 142 to the display device 102 via display interface 108, which can communicate the resume image 142 via display port 110. Moreover, in an example, the resume image 142 can be sent as part of a command that can indicate a type of memory (e.g., volatile or non-volatile) within which to store the resume image 142 at the display device 102, a type of the power down sequence being performed at the computing device 100, a type of a power on event for which to display the resume image 142 and/or the like. Moreover, for example, sending the resume image 142 can include sending a plurality of resume images, a period of time for displaying each of the plurality of resume images, etc., as described.

In sending the resume image at action 406, optionally at action 408, it can be determined that the resume image is different from a previous resume image sent to the display device. In an example, power managing component 112, e.g., in conjunction with processor 104 and/or memory 106 can determine the resume image 142 is different from the previous resume image sent to the display device 102. For example, as writing the resume image 142 to memory 126 of the display device 102 may take some time and resources, power managing component 112 may first determine that the resume image 142 was not previously provided to the display device 102. If the display device 102 was provided with the resume image in a previous power state transition, display device 102 can utilize the previously provided resume image for displaying in transitioning to a power on state from the power down sequence initiated at action 402. Thus, this optional action 408 may conserve time and resources used by the computing device 100 and/or display device 102. In one example, power managing component 112 may query the display controller 124 to determine whether the resume image 142 has changed and/or is otherwise the same as the generated resume image 142 (e.g., by verifying a checksum or other hash value).

In method 400, optionally at action 410, an indication of whether to store the resume image in a volatile or non-volatile memory can be sent to the display device. In an example, power managing component 112, e.g., in conjunction with processor 104, memory 106, display interface 108, and/or display port 110, can send, to the display device 102, the indication of whether to store the resume image 142 in the volatile or non-volatile memory. For example, writing the resume image 142 to volatile memory (e.g., DRAM/SRAM) may take less time than writing to non-volatile memory (e.g., flash memory), but may also be subject to deletion where power to the memory 126 is terminated. Thus, in an example (e.g., where the display controller 124 can access both volatile and non-volatile memory), power managing component 112 can specify whether to write the resume image 142 to volatile memory (e.g., for a faster power down sequence, such as transitioning to a standby or sleep state) or to non-volatile memory (e.g., for transitioning to a hibernate or power off state).

In method 400, optionally at action 412, the power down sequence can be delayed until sending the resume image is completed. In an example, power managing component 112, e.g., in conjunction with processor 104, memory 106, display interface 108, and/or display port 110, can delay the power down sequence until sending the resume image 142 is completed. In an example, an indication that writing the resume image 142 is completed can be received from display device 102 via display port 110 (and display interface 108). Power managing component 112, in this example, can receive the indication, and accordingly continue or complete the power down sequence to decrease or terminate power to one or more components of the computing device 100 (which may include display device 102).

In method 400, optionally at action 414, a power on event can be sent to the display device. In an example, power managing component 112, e.g., in conjunction with processor 104, memory 106, display interface 108, and/or display port 110, can send the power on event to the display device. For example, the power on event can correspond to a power on sequence initiated at the computing device 100 (e.g., based on detecting activation of a power button or other input at computing device 100). For example, the power on event can correspond to an initial signal sent to the display device 102 via display interface 108 (and display port 110), which can include an indication that the computing device 100 is transitioning to a more active power state (e.g., full power state). In addition, the initial signal may include a command to power on one or more portions of the display device 102, a type of the power on sequence being performed by the computing device 100, etc. In another example, the initial signal may correspond to a power signal to provide power to one or more portions of the display device 102 from which power was decreased or terminated as part of the power down sequence at action 402.

In method 400, optionally at action 416, image data can be sent to the display device for displaying images after completing a power on sequence corresponding to the power on event. In an example, processor 104, e.g., in conjunction with memory 106, display interface 108, display port 110, and/or an operating system executing on processor 104, can send the image data 140 to the display device 102 for displaying images after completing a power on sequence corresponding to the power on event. For example, after the power on sequence is completed, the computing device 100 can begin sending image data 140 to the display device 102 for displaying images generated by computing device 100. Accordingly, the display device 102 can display the images instead of the resume image 142, as described above.

Figure 5:
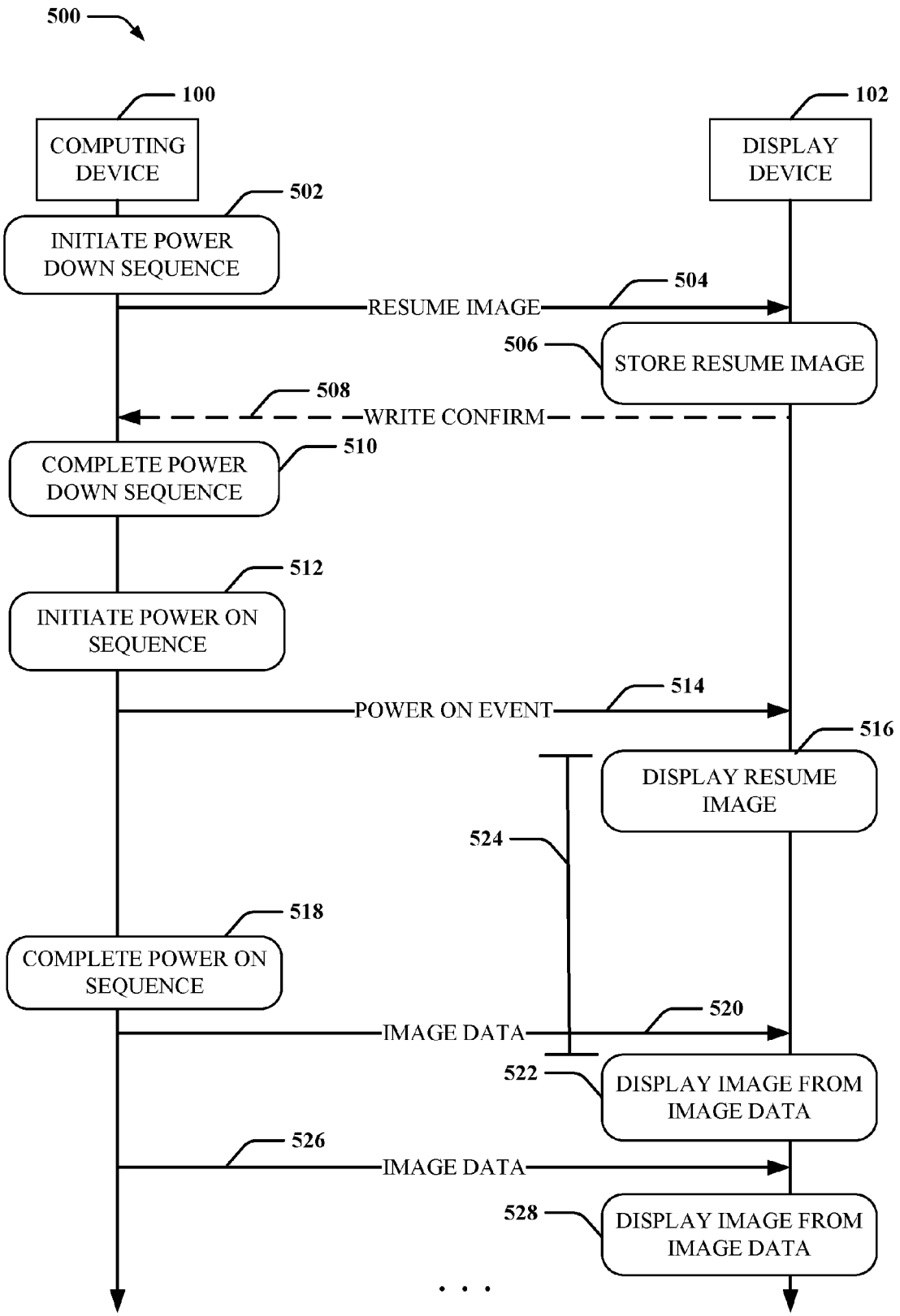
FIG. 5 is a schematic diagram of an example of a computing device and display device for communicating image data in accordance with examples described herein.

FIG. 5 illustrates an example of a system 500 for displaying a resume image when transitioning between power states. System 500 includes a computing device 100 that is communicatively coupled with a display device 102. Computing device 100 can communicate with display device 102 to display one or more images (e.g., via coupled display ports, which may be external ports, embedded ports where computing device 100 and display device 102 are within the same housing or separable portions of a housing, etc.), as described. Computing device 100 can initiate a power down sequence at 502 to transition to a power state with decreased or terminated power to one or more components of the computing device 100. As part of the power down sequence, for example, computing device 100 can send a resume image to display device 102 at 504. Display device 102 can store the resume image at 506. As described above, a display controller of the display device 102 can store the resume image in a volatile or non-volatile memory (and/or a command within which the resume image is sent at 504, or a separate command, may specify whether to store the resume image in volatile or non-volatile memory if display device 102 is equipped with both). Display device 102 may optionally send a write confirm response to the computing device 100 at 508 to confirm that writing of the resume image to the memory of the display device 102 is completed. Computing device 100 can complete the power down sequence at 510 (e.g., based on receiving the write confirm at 508 or otherwise after sending the resume image 504 to the display device 102), which can include decreasing and/or terminating power to one or more components of computing device 100, which may include at least a portion of display device 102, to achieve associated power state.

After a period of time, computing device 100 may initiate a power on sequence 512, which may be based on detecting activation of a power button, receiving input from an input device or network interface, detecting expiration of a period of time, and/or the like. Computing device 100 may send a power on event 514 to the display device 102 to indicate initiation of the power on sequence. In one example, the power on event may indicate the power on sequence or may be a power signal. In any case, display device 102 can detect the power on event, and can display the resume image at 516 (which may occur at a reduced brightness level), where display device 102 can obtain the resume image from memory. Computing device 100 can complete the power on sequence at 518, which may include restoring power to at least a portion of components of the computing device 100 from which power was decreased or terminated in the power down sequence. After completion of the power on sequence 518, computing device 100 can send image data 520 to the display device 102 for displaying at 520. Display device can accordingly display images from the image data at 522 instead of the resume image. Thus, for the period of time 524, display device 102 can display the resume image 516 instead of merely displaying a blank screen. Subsequently, the computing device 100 can provide image data at 526, which display device 102 can display at 528, and so on until a next power down sequence occurs.

Figure 6:
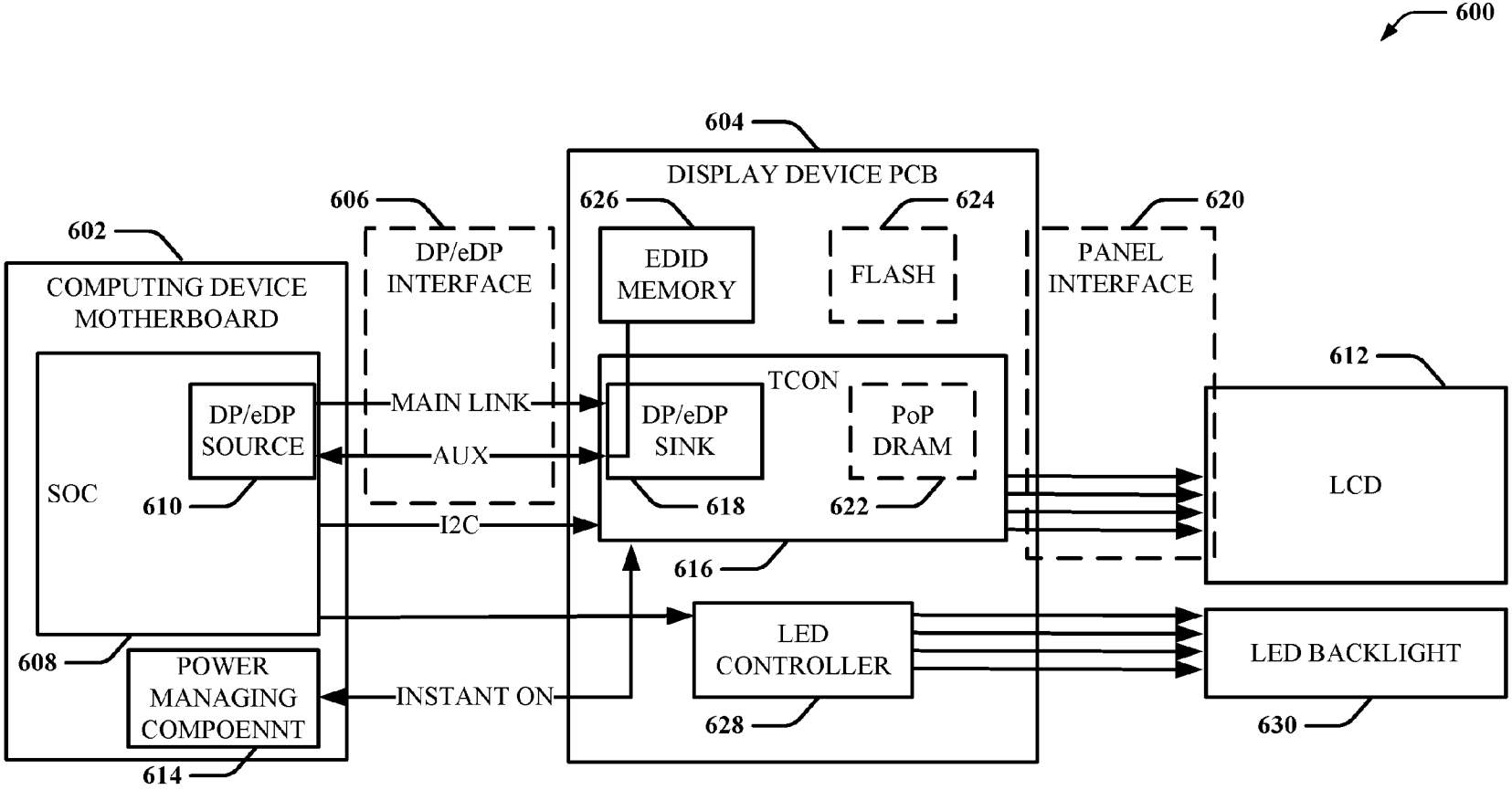
FIG. 6 is a schematic diagram of an example of a computing device motherboard and display device printed circuit board communicatively coupled for sending image data in accordance with examples described herein.

FIG. 6 illustrates an example of a system 600 including portions of a computing device and display device that are communicatively coupled to provide functionality described herein, such as to communicate a resume image. System 600 includes a computing device motherboard 602 (which may be implemented within a computing device 100) that is coupled with a display device PCB 604 (which may be implemented within a display device 102) via a DP/embedded DP (eDP) interface 606. For example, computing device motherboard 602 can include a system on chip (SoC) 608 that can provide one or more processors (e.g., processor 104) and/or memory components (e.g., memory 106) to execute an operating system and provide functionality based on inputs to the computing device and/or outputs from the computing device. Additionally, the SoC 608 can include a DP/eDP source 610 (which may be similar to or include display port 110) for coupling to the display device PCB 604 via DP/eDP interface 606 to facilitate displaying one or more images on a display, such as LCD 612. Computing device motherboard 602 may also include a power managing component 614, which may be similar to power managing component 112 for controlling computing device motherboard 602 and/or display device 604 to increase/decrease power to corresponding components in transitioning between power states.

Display device PCB 604 can include a TCON 616 (which may be similar to display controller 124) coupled with a DP/eDP sink 618 (which may be similar to display port 128) for receiving image data from DP/eDP source 610 via DP/eDP interface 606 and providing signals to LCD 612 (which may be similar to display 122) via a panel interface 620 to display images corresponding to the image data. For example, DP/eDP interface 606 can include a main link over which DP/eDP source 610 can communicate image data to DP/eDP sink 618 and/or an auxiliary (AUX) channel over which DP/eDP source 610 can communicate other data or signals to DP/eDP sink 618 and/or vice versa (such as an indication that a resume image is written to a memory at the display device PCB 604, e.g., write confirm 508 in FIG. 5).

Display device PCB 604 can also include a package-on-package (PoP) DRAM 622 and/or flash memory 624 (which may be similar to memory 126) for storing a resume image, which may be a high resolution image for displaying on LCD 612, as described above. Display device PCB 604 can also include an extended display identification data (EDID) memory 626 for storing one or more parameters related to capabilities of the display device PCB 604 and/or components thereof. For example, EDID memory 626 can store and provide, e.g., via the AUX channel, information indicating the display device PCB 604 as capable of receiving and storing resume images, storing multiple resume images in different types of memory (e.g., PoP DRAM 622 and/or flash memory 624), storing multiple resume images for display in a slideshow, animation, or video form, controlling a LED backlight 630, etc., which SoC 608 can obtain and utilize in determining commands to provide to the display device PCB 604 regarding storing a resume image, as described above. Display device PCB 604 may also include a LED controller 628 (which may be similar to brightness controller 130) for controlling a LED backlight of LCD 612 to adjust a brightness at which the images are displayed.

In an example, SoC 608 may be operating a power managing component 112, as described herein. For example, SoC 608 can generate one or more resume images for display on LCD 612, as described, which may be part of a power down sequence, and may send the resume image to TCON 616 via DP/eDP source 610 over DP/eDP interface 606 (e.g., over the main channel or AUX channel). In one example, SoC 608 and TCON 616 may be connected via an inter-integrated circuit (I2C) bus, and SoC 608 may send the resume image to TCON 616 over the I2C bus. In other examples, additional interfaces may be used, such as a universal serial bus (USB) or other connection between the SoC 608 and TCON 616. In any case, TCON 616 can store the resume image in POP DRAM 622 and/or flash memory 624 (which may be based on a command received from the SoC 608 related to storing the resume image. For example, flash memory 624 may be around 4 megabytes to store 8 megapixels at least at an 8:1 compression ratio. Additionally, in this regard, TCON 616 may include a hardware decoder for decompressing the resume image.

The SoC 608 can subsequently complete a power down sequence at the computing device. After a period of time, SoC 608 can transition to a power on state, and perform a corresponding power on sequence, which may include sending an initial signal as a power on event to the TCON 616 (e.g., over the main link, AUX channel, I2C bus, general purpose input/output (GPIO), etc.). TCON 616 can accordingly obtain the resume image from PoP DRAM 622 and/or flash memory 624 (which may be based on parameters in the previously received command, the initial signal, determining whether a resume image exists in one of PoP DRAM 622 or flash memory 624, etc.), and may display the resume image on LCD 612 by sending corresponding signals thereto over the panel interface 620. In addition, LED controller 628 may control the LED backlight 630 to dim to a value that is a portion of a configured value for the LED backlight 630 or another fixed value to provide a dimmed effect for the resume image.

Subsequently, when the power on sequence is completed, the SoC 608 can begin sending image data to TCON 616 over the main link of DP/eDP interface 606, and TCON 616 can display images on LCD 612 that correspond to the image data (instead of displaying the resume image). In one example, TCON 616 may, at this point, delete the resume image from the PoP DRAM 622 and/or flash memory 624.

Figure 7:
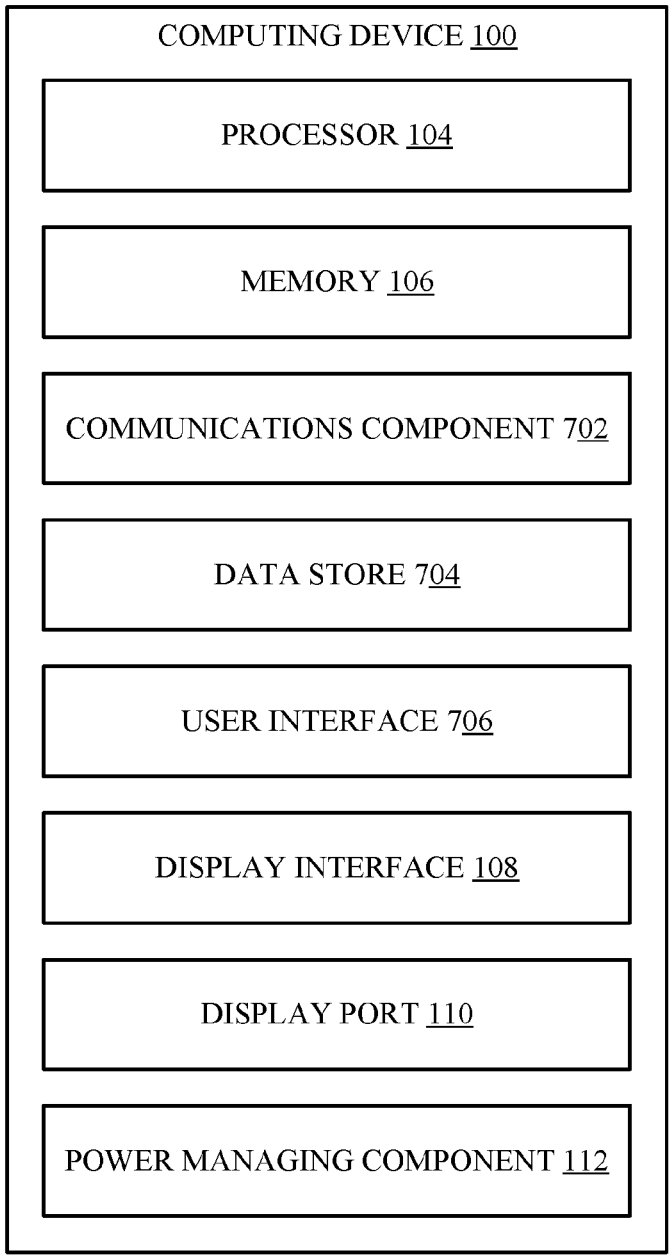
FIG. 7 is a schematic diagram of an example of a computing device for performing functions described herein.

FIG. 7 illustrates an example of computing device 100 including additional optional component details as those shown in FIG. 1. In one example, computing device 100 may include processor 104 for carrying out processing functions associated with one or more of components and functions described herein. Processor 104 can include a single or multiple set of processors or multi-core processors. Moreover, processor 104 can be implemented as an integrated processing system and/or a distributed processing system.

Computing device 100 may further include memory 106, such as for storing local versions of applications being executed by processor 104, related instructions, parameters, etc. Memory 106 can include a type of memory usable by a computer, such as random access memory (RAM), read only memory (ROM), tapes, magnetic discs, optical discs, volatile memory, non-volatile memory, and any combination thereof. Additionally, processor 104 and memory 106 may include and execute power managing component 112, an operating system executing on processor 104, and/or other components of the computing device 100.

Further, computing device 100 may include a communications component 702 that provides for establishing and maintaining communications with one or more other devices, parties, entities, etc. utilizing hardware, software, and services as described herein. Communications component 702 may carry communications between components on computing device 100, as well as between computing device 100 and external devices, such as devices located across a communications network and/or devices serially or locally connected to computing device 100. For example, communications component 702 may include one or more buses, and may further include transmit chain components and receive chain components associated with a wireless or wired transmitter and receiver, respectively, operable for interfacing with external devices.

Additionally, computing device 100 may include a data store 704, which can be any suitable combination of hardware and/or software, that provides for mass storage of information, databases, and programs employed in connection with examples described herein. For example, data store 704 may be or may include a data repository for applications and/or related parameters (e.g., power managing component 112) not currently being executed by processor 104. In addition, data store 704 may be a data repository for power managing component 112, an operating system executing on the processor 104, and/or one or more other components of the computing device 100.

Computing device 100 may also include a user interface component 706 operable to receive inputs from a user of computing device 100 and further operable to generate outputs for presentation to the user (e.g., via display interface 108 and display port 110 to a display device). User interface component 706 may include one or more input devices, including but not limited to a keyboard, a number pad, a mouse, a touch-sensitive display, a navigation key, a function key, a microphone, a voice recognition component, a gesture recognition component, a depth sensor, a gaze tracking sensor, any other mechanism capable of receiving an input from a user, or any combination thereof. Further, user interface component 706 may include one or more output devices, including but not limited to a display interface 108 and/or display port 110, a speaker, a haptic feedback mechanism, a printer, any other mechanism capable of presenting an output to a user, or any combination thereof.

An example display device includes a display configured for displaying images, a display controller configured for receiving image data via a display port when coupled to a computing device, and for sending signals to the display, based on the image data, to cause the display to display the images, and a memory accessible by the display controller for storing a resume image received from the computing device, where the display controller is further configured for detecting a power on event, accessing the memory to obtain the resume image, and sending signals to the display to cause display of the resume image based at least in part on detecting the power on event.

Another example display device of any preceding display device includes where the display controller is further configured to receive the resume image from the computing device in a power down sequence initiated with the computing device.

Another example display device of any preceding display device includes where resume image is a high resolution image configured by the computing device for display at a lock screen.

Another example display device of any preceding display device includes where the display controller is further configured for detecting subsequent image data received from the computing device at the display port after detecting the power on event, and sending subsequent signals to the display to cause display of images corresponding to the subsequent image data instead of the resume image based in part on detecting the subsequent image data.

Another example display device of any preceding display device includes brightness controller configured for increasing a brightness value of the display to a configured value based at least in part on the display controller detecting the subsequent image data received from the computing device at the display port.

Another example display device of any preceding display device includes where the brightness controller is further configured for setting a brightness value of the display less than the configured value while the display is displaying the resume image.

Another example display device of any preceding display device includes where the memory is at least one of a volatile memory or a non-volatile memory.

Another example display device of any preceding display device includes where the memory includes the volatile memory and the non-volatile memory, and where the display controller is configured for storing the resume image in either the volatile memory or the non-volatile memory based in part on an indication from the computing device.

Another example display device of any preceding display device includes where the display device is integrated in a housing with the computing device, and where the display port is an embedded display port coupled with a display interface of the computing device.

An example computing device includes a memory, a display interface configured for communicating image data to a display device for displaying on a display, and at least one processor coupled to the memory and the display interface via a bus, where the at least one processor is configured for initiating a power down sequence at the computing device related to decreasing or terminating power provided to one or more components of the computing device including the display interface, generating a resume image to be displayed on the display in a subsequent power on event and before the display interface communicates image data to the display device following the power on event, and sending, as part of the power down sequence and before decreasing or terminating power to the display interface, the resume image to the display device via the display interface.

Another example computing device of any preceding computing device includes where sending the resume image to the display device is based in part on determining that the resume image is different from a previous resume image sent to the display device.

Another example computing device of any preceding computing device includes where the at least one processor is further configured for delaying the power down sequence at least until sending the resume image to the display device is completed.

Another example computing device of any preceding computing device includes where the at least one processor is further configured for sending, to the display device, an indication of whether to store the resume image in a volatile memory or a non-volatile memory.

Another example computing device of any preceding computing device includes where the at least one processor is further configured for generating the indication based on a type of the power down sequence.

Another example computing device of any preceding computing device includes where the resume image is a high resolution image configured for display at a lock screen.

Another example computing device of any preceding computing device includes where the display device is integrated in a housing with the computing device, and where the display interface is coupled with an embedded display port of the display device.

An example method for displaying a resume image based on a power on event at a display device include initiating a power down sequence at a computing device, communicating the resume image from the computing device to an display device based in part on the power down sequence, storing the resume image in a memory accessible by a display controller of the display device, detecting a power on event at the computing device, displaying, on the display device, the resume image from the memory accessible by the display controller based in part on detecting the power on event, and displaying, on the display device, subsequent images based on image data received from the computing device following the power on event.

Another example method of any preceding method includes setting a brightness value to less than a configured value when displaying the resume image, and setting the brightness value to the configured value when displaying the subsequent images.

Another example method of any preceding method includes where communicating the resume image from the computing device to the display device is based at least in part on determining that the resume image has changed from a previous resume image communicated from the computing device to the display device.

Another example method of any preceding method includes where the memory includes at least one of a volatile memory or a non-volatile memory.

By way of example, an element, or any portion of an element, or any combination of elements may be implemented with a "processing system" that includes one or more processors. Examples of processors include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Accordingly, in one or more examples, one or more of the functions described may be implemented in hardware, software, firmware, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), and floppy disk where disks usually reproduce data magnetically, while discs reproduce data optically with lasers. Combinations of the above should also be included within the scope of computer-readable media.

The previous description is provided to enable any person skilled in the art to practice the various examples described herein. Various modifications to these examples will be readily apparent to those skilled in the art, and the generic principles defined herein may be applied to other examples. Thus, the claims are not intended to be limited to the examples shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various examples described herein that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A display device, comprising:

a display configured for displaying images;

a display port configured for receiving image data from a computing device coupled to the display port via a source display port;

a hardware timing controller configured for sending signals to the display to control display timing for displaying the images corresponding to the image data received via the display port;

a memory coupled to the hardware timing controller and accessible by the hardware timing controller for storing a resume image received from the computing device, wherein the hardware timing controller is further configured for detecting a power on event related to the computing device, accessing the memory to obtain the resume image, and sending signals to the display to cause display of the resume image based at least in part on detecting the power on event;

wherein the hardware timing controller is further configured for detecting subsequent image data received from the computing device at the display port after detecting the power on event, and sending subsequent signals to the display to cause display of images corresponding to the subsequent image data instead of the resume image based in part on detecting the subsequent image data; and a brightness controller configured for increasing a brightness value of the display to a configured value based at least in part on the hardware timing controller detecting the subsequent image data received from the computing device at the display port.

2. The display device of claim 1, wherein the hardware timing controller is further configured to receive the resume image from the computing device in a power down sequence initiated with the computing device.

3. The display device of claim 1, wherein the resume image is a high resolution image configured by the computing device for display at a lock screen.

4. The display device of claim 1, wherein the brightness controller is further configured for setting the brightness value of the display less than the configured value while the display is displaying the resume image.

5. The display device of claim 1, wherein the memory is at least one of a volatile memory or a non-volatile memory.

6. The display device of claim 5, wherein the memory comprises the volatile memory and the non-volatile memory, and wherein the hardware timing controller is configured for storing the resume image in either the volatile memory or the non-volatile memory based in part on an indication from the computing device.

7. The display device of claim 1, wherein the display device is integrated in a housing with the computing device, and wherein the display port is an embedded display port coupled with a display interface of the computing device.

8. A computing device, comprising:

a memory;

a display interface configured for communicating image data to a display device for displaying on a display; and at least one processor coupled to the memory and the display interface via a bus, wherein the at least one processor is configured for:

initiating a power down sequence at the computing device related to decreasing or terminating power provided to one or more components of the computing device including the display interface;

generating a resume image to be displayed on the display in a subsequent power on event and before the display interface communicates image data to the display device following the power on event; and sending, as part of the power down sequence and before decreasing or terminating power to the display interface, the resume image to the display device via the display interface, wherein the display device stores the resume image in a display memory on the display device that is accessible by a hardware timing controller;

wherein the display device includes the hardware timing controller configured for detecting subsequent image data received from the display interface after detecting the power on event, and sending subsequent signals to the display to cause display of images corresponding to the subsequent image data instead of the resume image based in part on detecting the subsequent image data; and wherein the display device includes a brightness controller configured for increasing a brightness value of the display to a configured value based at least in part on the hardware timing controller detecting the subsequent image data received from the display interface.

9. The computing device of claim 8, wherein sending the resume image to the display device is based in part on determining that the resume image is different from a previous resume image sent to the display device.

10. The computing device of claim 8, wherein the at least one processor is further configured for delaying the power down sequence at least until sending the resume image to the display device is completed.

11. The computing device of claim 8, wherein the at least one processor is further configured for sending, to the display device, an indication to store the resume image in a volatile memory or a non-volatile memory.

12. The computing device of claim 9, wherein the at least one processor is further configured for generating the indication based on a type of the power down sequence.

13. The computing device of claim 8, wherein the resume image is a high resolution image configured for display at a lock screen.

14. The computing device of claim 8, wherein the display device is integrated in a housing with the computing device, and wherein the display interface is coupled with an embedded display port of the display device.

15. A method for displaying a resume image based on a power on event at a display device, comprising:

initiating a power down sequence at a computing device;

communicating the resume image from the computing device to the display device based in part on the power down sequence;

storing the resume image in a memory accessible by a hardware timing controller of the display device, wherein the hardware timing controller is configured for sending signals to a display of the display device for controlling timing for displaying images on the display;

detecting a power on event at the computing device;

displaying, by the hardware timing controller and on the display device, and based in part on detecting the power on event, the resume image from the memory accessible by the hardware timing controller;

detecting, by the hardware timing controller, subsequent image data received from the computing device at a display port after detecting the power on event;

sending, by the hardware timing controller and based on detecting the subsequent image data, subsequent signals to the display device to cause display of images corresponding to the subsequent image data instead of the resume image;

increasing, based at least in part on the hardware timing controller detecting the subsequent image data received from the computing device at the display port, a brightness value of the display device to a configured value; and displaying, on the display device, subsequent images based on the subsequent signals received from the hardware timing controller following the power on event.

16. The method of claim 15, further comprising setting the brightness value to less than the configured value when displaying the resume image, and setting the brightness value to the configured value when displaying the subsequent images.

17. The method of claim 15, wherein communicating the resume image from the computing device to the display device is based at least in part on determining that the resume image has changed from a previous resume image communicated from the computing device to the display device.

18. The method of claim 15, wherein the memory comprises at least one of a volatile memory or a non-volatile memory.

* * * * *